US010975883B2

(12) United States Patent
Yamashita

(10) Patent No.: US 10,975,883 B2
(45) Date of Patent: Apr. 13, 2021

(54) CENTRIFUGAL ROTARY MACHINE

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 133 days.

(21) Appl. No.: 16/484,496

(22) PCT Filed: Feb. 20, 2018

(86) PCT No.: PCT/JP2018/006083
§ 371 (c)(1),
(2) Date: Aug. 8, 2019

(87) PCT Pub. No.: WO2018/155458
PCT Pub. Date: Aug. 30, 2018

(65) Prior Publication Data

US 2020/0003226 A1 Jan. 2, 2020

(30) Foreign Application Priority Data

Feb. 22, 2017 (JP) ..... JP2017-031196

(51) Int. Cl.
*F04D 29/44* (2006.01)
*F04D 29/22* (2006.01)

(52) U.S. Cl.
CPC ..... *F04D 29/44* (2013.01); *F04D 29/22* (2013.01)

(58) Field of Classification Search
CPC ..... F04D 17/122; F04D 29/24; F04D 29/242; F04D 29/44; F04D 29/444; F04D 29/54;
(Continued)

(56) References Cited

U.S. PATENT DOCUMENTS 2,419,669 A 4/1947 Birmann
4,645,419 A * 2/1987 Furuya ..... F04D 29/444 415/208.2

(Continued)

FOREIGN PATENT DOCUMENTS

FR 2970508 A1 7/2012
GB 884507 A 12/1961

(Continued)

OTHER PUBLICATIONS

International Search Report issued in International Application No. PCT/JP2018/006083, dated May 29, 2018 (2 pages).

(Continued)

*Primary Examiner* — Brian P Wolcott

(74) *Attorney, Agent, or Firm* — Osha Bergman Watanabe & Burton LLP

(57) ABSTRACT

A flow path includes a return bend portion which guides a working fluid to an inside in the radial direction by reversing the working fluid discharged to an outside in a radial direction from an upstream-side impeller, and a guiding flow path which is connected to a downstream side of the return bend portion and leads the working fluid to the inside in the radial direction so as to guide the working fluid to the downstream-side impeller. In a return vane which is provided in the guiding flow path, a trailing edge is formed such that a second end portion on a second side in an axial direction is positioned closer to an inside in a radial direction than a first end portion on a first side in the axial direction.

18 Claims, 6 Drawing Sheets

(58) Field of Classification Search
CPC . F04D 29/542; F04D 29/544; F05D 2240/122
See application file for complete search history.

(56) References Cited

U.S. PATENT DOCUMENTS

| | | | | | |
|---|---|---|---|---|---|
| 4,725,196 | A * | 2/1988 | Kaneki | F04D 17/12 | 415/98 |
| 6,568,904 | B1 * | 5/2003 | Ueyama | F04D 29/448 | 415/199.2 |
| 8,602,730 | B2 * | 12/2013 | Richter | F04D 17/122 | 415/211.2 |
| 9,822,793 | B2 * | 11/2017 | Sezal | F04D 29/441 | |
| 10,711,796 | B2 * | 7/2020 | Michelassi | F04D 17/122 | |
| 10,731,664 | B2 * | 8/2020 | Iurisci | F04D 29/5826 | |
| 10,760,587 | B2 * | 9/2020 | Larosiliere | F04D 29/444 | |
| 10,844,863 | B2 * | 11/2020 | Yamashita | F04D 17/122 | |
| 2012/0230812 | A1 | 9/2012 | Jonen et al. | | |

FOREIGN PATENT DOCUMENTS

| | | | | | |
|---|---|---|---|---|---|
| GB | 1107039 | A * | 3/1968 | F04D 29/44 | |
| JP | S62162398 | U | 10/1987 | | |
| JP | 2002106487 | A | 4/2002 | | |
| JP | 3187468 | U | 11/2013 | | |

OTHER PUBLICATIONS

Written Opinion issued in corresponding International Application No. PCT/JP2018/006083, dated May 29, 2018 (7 pages).

* cited by examiner

CENTRIFUGAL ROTARY MACHINE

TECHNICAL FIELD

The present invention relates to a centrifugal rotary machine.

Priority is claimed on Japanese Patent Application No. 2017-031196, filed on Feb. 22, 2017, the content of which is incorporated herein by reference.

BACKGROUND ART

A rotary machine such as a centrifugal compressor mainly includes an impeller which rotates around an axis and a casing which covers an outer peripheral side of the impeller to form a flow path of a working fluid between the impeller and the casing.

In a multi-stage rotary machine including a plurality of stages of impeller in an axial direction, a flow path of each stage includes a diffuser flow path, a return bend portion, and a guiding flow path. The diffuser flow path is provided on a radially outer side of the impeller, extends radially outward of the axis from the impeller, and leads a working fluid, which is discharged from an outlet of the impeller, radially outward. The return bend portion is continuously provided to a radially outer side of the diffuser flow path and reveres a flow direction of the working fluid from a radially outer side to a radially inner side. The guiding flow path is provided on a downstream side of the return bend portion and leads the working fluid to an inlet of a subsequent stage impeller. The working fluid discharged from the outlet of the impeller has a component in a turning direction due to a rotation of the impeller around the axis. If the working fluid reaches the subsequent stage impeller via the diffuser flow path, the return bend portion, and the guiding flow path in a state where a turning component remains in the working fluid, it adversely affects compression processing for the working fluid in the subsequent stage impeller, and thus, efficiency of the rotary machine may decrease.

PTLs 1 and 2 disclose a configuration including a return vane (guide vane, vane) in the guiding flow path for a purpose of rectification. The return vane is provided in the guiding flow path, and thus, a component in a turning direction of a working fluid which is discharged from an outlet of an impeller and has passed through a diffuser flow path and a return bend is removed, and a reduction in efficiency of a rotary machine is suppressed.

CITATION LIST

Patent Literature

[PTL 1] Japanese Unexamined Utility Model Application, First Publication No. S62-162398

[PTL 2] Japanese Unexamined Patent Application, First Publication No. 2002-106487

SUMMARY OF INVENTION

Technical Problem

However, in the configurations described in PTLs 1 and 2, even when the return vane is provided, it is difficult to completely remove the component in the turning direction of the working fluid at an outlet of the return vane. Accordingly, in the outlet of the return vane, a distribution occurs in a velocity component in the turning direction of the working fluid in the guiding flow path. For example, in the guiding flow path, a difference may occur in magnitudes of the velocity components in the turning direction remaining in the working fluid via the return vane on an axially upstream side and an axially downstream side of the impeller.

Accordingly, the present invention is made in consideration of the above-described circumstances, and an object thereof is to provide a centrifugal rotary machine capable of suppressing the turning component remaining in the working fluid through the return vane to improve efficiency of the rotary machine.

Solution to Problem

The present invention adopts the following means in order to solve the above-described problems.

According to a first aspect of the present invention, a centrifugal rotary machine includes: impellers which are provided in a plurality of stages along an axial direction and discharge a working fluid sucked from a first side in the axial direction to an outside in a radial direction of an axis; and a casing which is provided to surround the impellers and forms a flow path which leads the working fluid discharged from an upstream-side impeller positioned on the first side in the axial direction to a downstream-side impeller positioned on a second side in the axial direction. The flow path includes a return bend portion which guides the working fluid to an inside in the radial direction by reversing the working fluid discharged to an outside in the radial direction from the upstream-side impeller, and a guiding flow path which is connected to a downstream side of the return bend portion and leads the working fluid to the inside in the radial direction so as to guide the working fluid to the downstream-side impeller. The centrifugal rotary machine further includes a plurality of return vanes Which are provided in the guiding flow path guiding the working fluid in at least one impeller from among the impellers provided in the plurality of stages and are provided at intervals in a circumferential direction around the axis. In each return vane, a trailing edge positioned on the inside in the radial direction is formed such that a second end portion on the second side in the axial direction is positioned closer to the inside in the radial direction than a first end portion on the first side in the axial direction.

According to this configuration, in the return vane, the second end portion of the trailing edge positioned on the inside in the radial direction is positioned closer to the inside in the radial direction than the first end portion. Accordingly, in a suppression effect of a turning component of the working fluid applied by the return vane with respect to the working fluid flowing along the return vane in the guiding flow path, the suppression effect on the second side in the axial direction is higher than the suppression effect on the first side in the axial direction. Accordingly, it is possible to suppress the turning component remaining in the working fluid via the return vane.

In a second aspect of the present invention providing the centrifugal rotary machine according to the first aspect, the return vane may be formed such that a length along a flow direction of the working fluid on the second side in the axial direction is longer than that on the first side in the axial direction.

In this way, the length of the return vane along the flow direction of the working fluid on the second side (downstream side) in the axial direction is longer than that on the first side (upstream side) in the axial direction, and thus, it is possible to increase the length of the working fluid flowing along the return vane in the guiding flow path. Accordingly, in the suppression effect of the turning component of the working fluid, it is possible to increase the suppression effect on the second side in the axial direction.

In a third aspect of the present invention providing the centrifugal rotary machine according to in the first or second aspect, the trailing edge of the return vane may gradually extend to the inside in the radial direction from the first end portion toward the second end portion.

Accordingly, the suppression effect of the turning component of the working fluid can gradually increase from the first side in the axial direction toward the second side.

In a fourth aspect of the present invention providing the centrifugal rotary machine according to the first or second aspect, the trailing edge of the return vane may be curvedly formed to be convex toward the inside in the radial direction or to be concave toward the outside in the radial direction between the first end portion and the second end portion.

According to this configuration, it is possible to increase or decrease the suppression effect of the turning component of the working fluid applied by the return vane between the first end portion on the first side in the axial direction and the second portion on the second side in the axial direction. Accordingly, it is possible to optimize the suppressing effect of the turning component of the working fluid.

In a fifth aspect of the present invention providing the centrifugal rotary machine according to any one of the first to fourth aspects, in the trailing edge of the return vane, the second end portion may be positioned closer to the inside in the radial direction than a normal line extending perpendicularly to an upstream wall surface on the first side in the axial direction in the guiding flow path from the first end portion.

Accordingly, in the trailing edge of the return vane, the second end portion is positioned closer to the inside in the radial direction than the first end portion.

In a sixth aspect of the present invention providing the centrifugal rotary machine according to any one of the first to fifth aspects, in the return vane, a leading edge positioned on the outside in the radial direction may be linearly formed along the axis.

Accordingly, the leading edge is linearly formed, and thus, it is possible to easily process the leading edge.

In a seventh aspect of the present invention providing the centrifugal rotary machine according to any one of the first to sixth aspects, in the return vane, an axial length of the trailing edge may be longer than that of the leading edge positioned on the outside in the radial direction.

Advantageous Effects of Invention

According to the centrifugal rotary machine of the present invention, it is possible to suppress a turning component remaining in a working fluid via a return vane so as to improve efficiency of the rotary machine.

DESCRIPTION OF EMBODIMENTS

Hereinafter, a centrifugal compressor (centrifugal rotary machine) according to an embodiment of the present invention will be described with reference to the drawings.

First Embodiment

Figure 1:
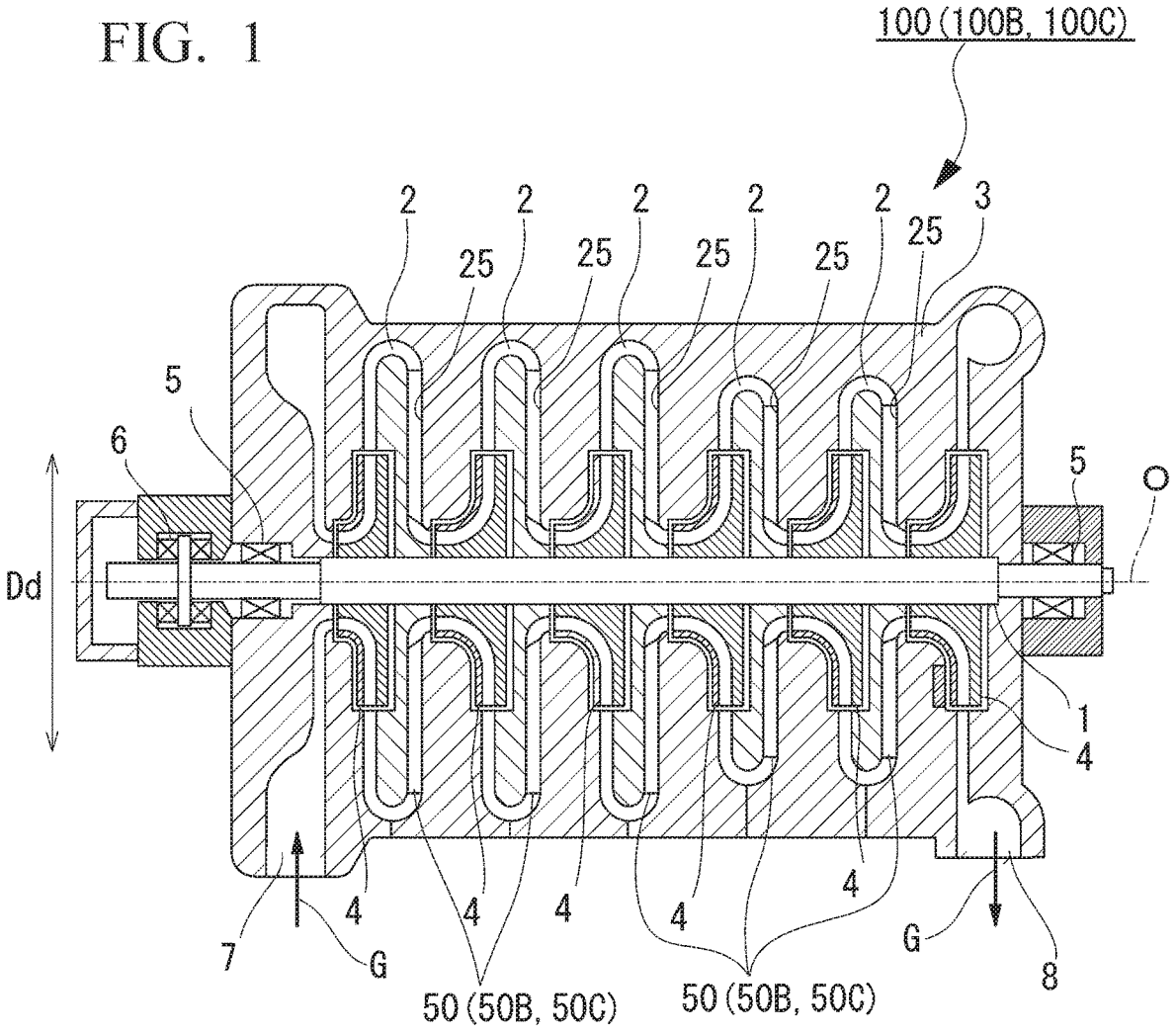
FIG. 1 is a schematic view showing a configuration of a centrifugal compressor according to each embodiment of the present invention.
Figure 2:
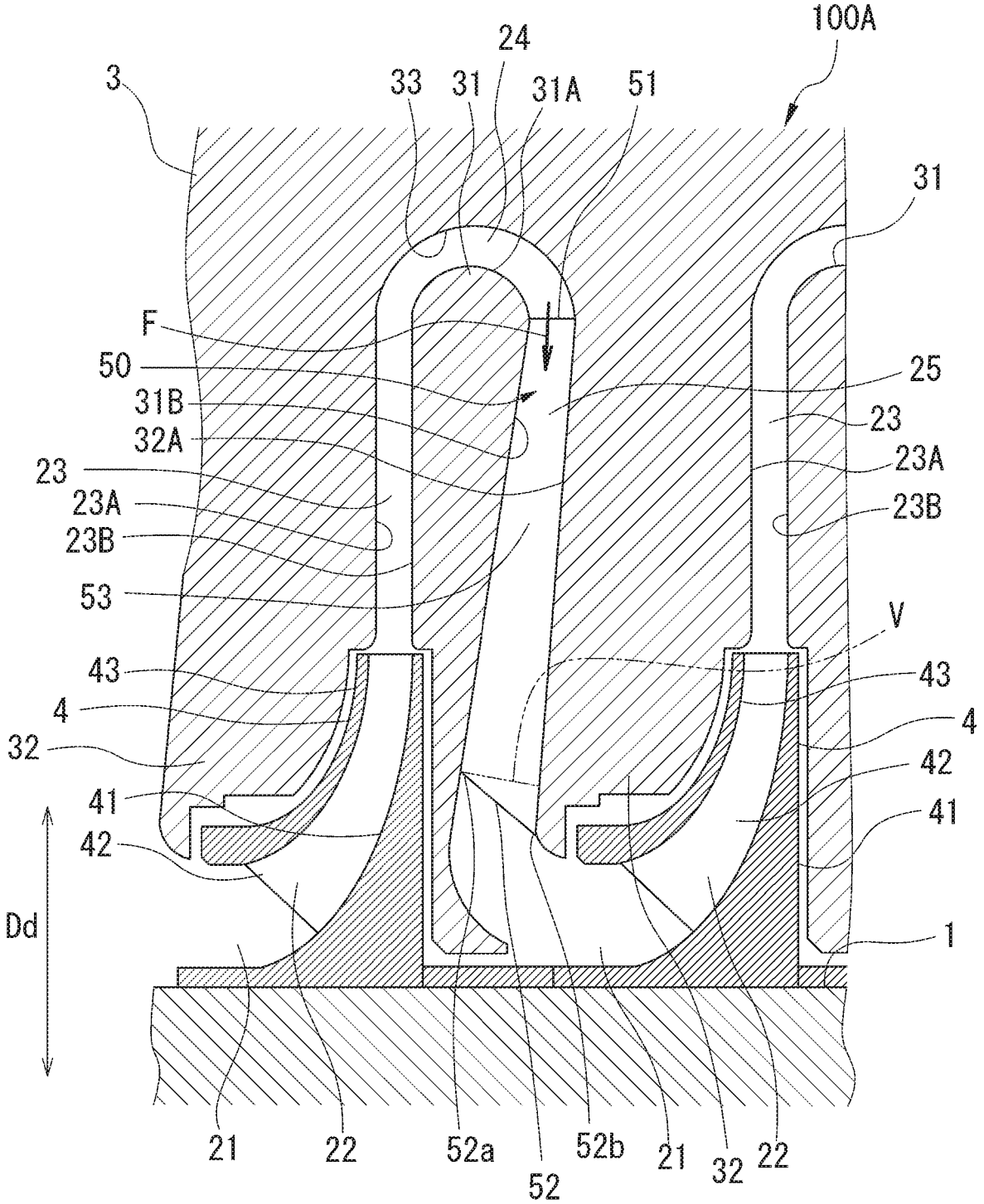
FIG. 2 is a view showing a configuration of a guiding flow path of a centrifugal compressor according to a first embodiment of the present invention, and is a view when the guiding flow path is viewed in a direction intersecting an axial direction.
Figure 3:
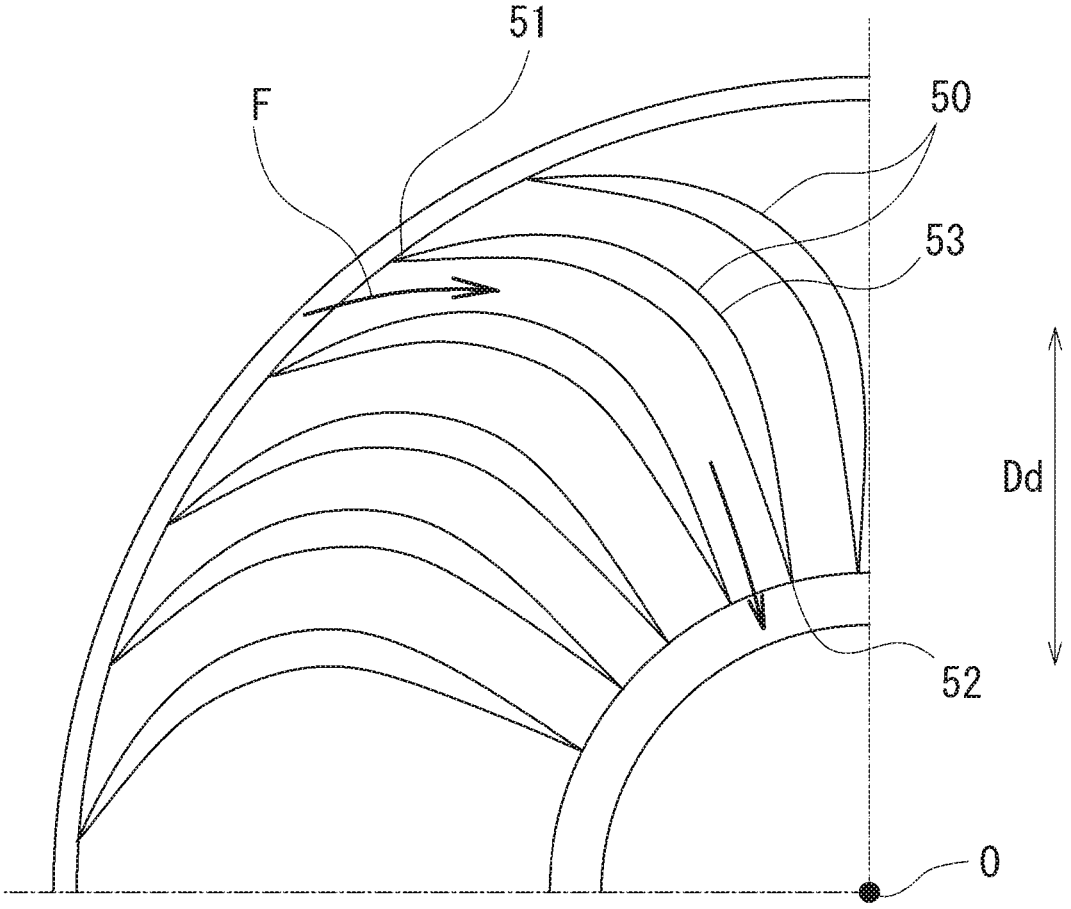
FIG. 3 is an enlarged sectional view of a main portion of the centrifugal compressor.
Figure 4:
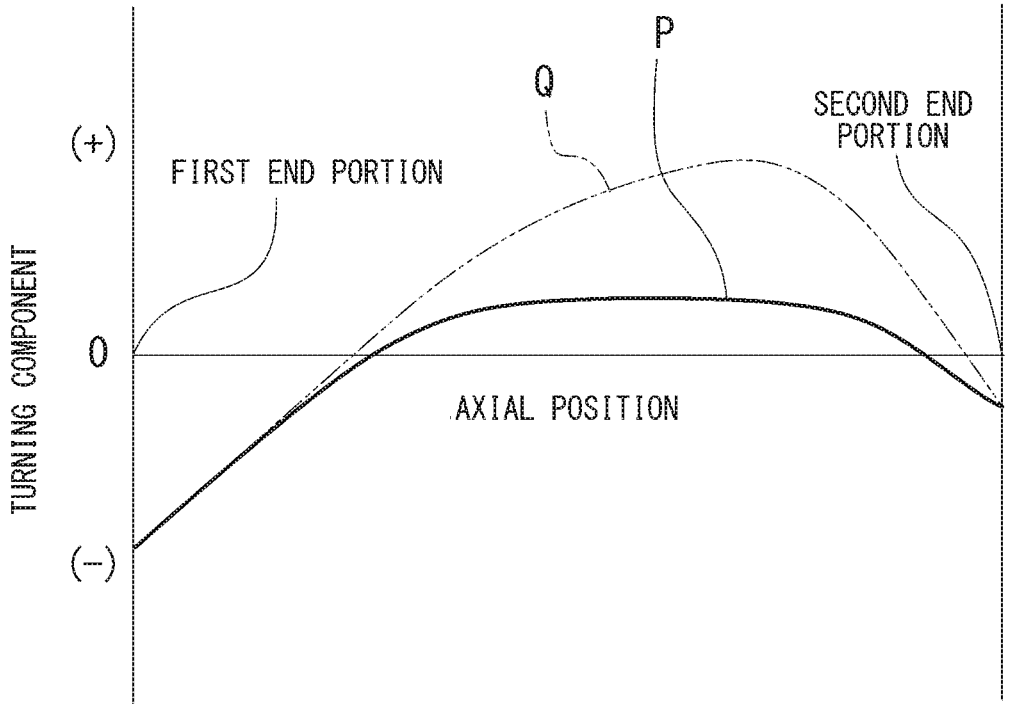
FIG. 4 is a diagram showing a result of a simulation of a distribution of a turning component at a guiding flow path outlet in the axial direction of the guiding flow path.

FIG. 1 is a schematic view showing a configuration of a centrifugal compressor according to each embodiment of the present invention. FIG. 2 is a view showing a configuration of a guiding flow path of a centrifugal compressor according to a first embodiment of the present invention, and is a view when the guiding flow path is viewed in a direction intersecting an axial direction. FIG. 3 is an enlarged sectional view of a main portion of the centrifugal compressor. FIG. 4 is a diagram showing a result of a simulation of a distribution of a turning component at a guiding flow path outlet in the axial direction of the guiding flow path.

As shown in FIG. 1, a centrifugal compressor 100 includes a rotor 1, a casing 3, and a plurality of stages of impellers 4 which are provided in the rotor 1.

The rotor 1 extends so as to penetrate inside the casing 3 along an axis O. At both ends of the casing 3 in an axis O direction, there are provided a journal bearing 5 and a thrust bearing 6 respectively. The rotor 1 is rotatably supported around the axis O by the journal bearing 5 and the thrust bearing 6.

The casing 3 is formed in an approximately cylindrical shape which extends along the axis O. An internal space, in which a diameter increase and a diameter decrease are repeated, is formed inside the casing 3. In the casing 3, the plurality of impellers 4 are accommodated in the internal space, and thus, the casing 3 is provided to cover the rotor 1 and a periphery of the plurality of stages of impellers 4, and forms flow paths 2 between the rotor 1 and the casing 3.

An intake port 7 for taking in air serving as a working fluid G from an outside and feeding the air into the flow path 2 is provided on a first side of the casing 3 in the axis O direction. In addition, an exhaust port 8 through which the compressed working fluid G inside the casing 3 is exhausted from the flow path 2 is provided on a second side of the casing 3 in the axis O direction. Moreover, in the following descriptions, the first side on which the intake port 7 is positioned is referred to as an upstream side, and a second side on Which the exhaust port 8 is positioned is referred to as a downstream side.

A plurality of stages of impellers 4 are provided in the rotor 1 at intervals in the axis O direction, and for example, in the example of FIG. 1, six stages of impellers are provided. Each impeller 4 discharges the working fluid G sucked from the first side in the axis O direction to an outside in a radial direction Dd of the axis O.

As shown in FIG. 2, each impeller 4 has a disk 41, a vane 42, and a shroud 43.

When viewed in the axis O direction, the disk 41 has a substantially circular shape. When viewed in direction intersecting the axis O, the disk 41 is formed such that a radial dimension gradually increases from the first side (left side in FIG. 2) toward the second side (right side in FIG. 2) in the axis O direction, and thus, the disk has an approximately conical shape.

The vane 42 is provided on a conical surface facing the upstream side of both surfaces of the disk 41 in the axis O direction. A plurality of vanes 42 are radially arranged about the axis O toward the outside in the radial direction Dd. More specifically, each vane 42 is formed by a thin plate erected from an upstream surface of the disk 41 toward the upstream side. In addition, although not shown in detail, when viewed in the axis O direction, the plurality of vanes 42 are curved from one side in the circumferential direction toward the other side.

The shroud 43 is provided on upstream end edges of the vanes 42 so as to cover the plurality of vanes 42 from the upstream side. In other words, in general, the plurality of vanes 42 are interposed between the shroud 43 and the disk 41 in the axis O direction. Accordingly, a space is formed between the shroud 43, the disk 41, and a pair of vanes 42 adjacent to each other. This space is a portion (a compression flow path 22) of the flow path 2 described later.

The flow path 2 is a space which communicates with the impeller 4 configured as described above and the internal space of the casing 3. In the present embodiment, descriptions will be made on an assumption that one flow path 2 is formed for each one impeller 4 (one compression stage). The flow path 2 leads the working fluid G discharged from an upstream-side impeller 4 positioned on the first side in the axis O direction to a downstream-side impeller 4 positioned on the second side in the axis O direction. That is, in the centrifugal compressor 100, five flow paths 2 continuous from the upstream side toward the downstream side are formed so as to correspond to five impellers 4 except for a last stage impeller 4.

Each flow path 2 has a suction flow path 21, a compression flow path 22, a diffuser flow path 23, a return bend portion 24, and a guiding flow path 25.

In a first stage impeller 4, the suction flow path 21 is substantially directly connected to the intake port 7. An outside air is taken into the flow path 2 as the working fluid G by the suction flow path 21.

More specifically, the suction flow path 21 is gradually curved toward the outside in the radial direction Dd in the axis O direction from the upstream side toward the downstream side.

Each of the suction flow paths 21 of second stage and later stage impellers 4 is connected to a downstream end of a guiding flow path 25 (described late in a preceding stage (first stage) flow path 2. That is, as described above, a flow direction of the working fluid G which has passed through the guiding flow path 25 is changed such that the working fluid G flows toward the downstream side along the axis O.

The compression flow path 22 is a flow path which is surrounded by an upstream surface of the disk 41, a downstream surface of the shroud 43, and the pair of vanes 42 adjacent to each other in the circumferential direction. More specifically, a cross-sectional area of the compression flow path 22 gradually decreases from the inside in the radial direction Dd toward the outside. Accordingly, the working fluid G, which passes through the compression flow path 22 in a state where the impeller 4 is rotated, is gradually compressed and becomes a high-pressure fluid.

The diffuser flow path 23 is a flow path which is surrounded by a diffuser front wall 23A which is a portion of an inner peripheral wall forming the internal space of the casing 3 and a diffuser rear wall 23B of the partition member 31 and thus, extends from the inside of the axis O in the radial direction Dd toward the outside thereof. An inner end portion of the diffuser flow path 23 in the radial direction Dd communicates with an outer end portion of the compression flow path 22 in the radial direction Dd.

Moreover, the partition member 31 is integrally provided with an inner peripheral side of the casing 3, and thus, is a member which separates portions between the plurality of impellers 4 adjacent to each other in the axis O direction from each other. In addition, when viewed from the partition member 31, an extension portion 32 which is integrally provided with the same casing 3 is provided on an upstream side in a state where the diffuser flow path 23 and the impeller 4 are interposed therebetween. The extension portion 32 is a wall portion which extends from an inner peripheral surface (not shown) of the casing 3 toward the inside in the radial direction Dd.

The return bend portion 24 is a curved flow path which is surrounded by a reverse wall 33 of the casing 3 and an outer peripheral wall 31A of the partition member 31. One end side (upstream side) of the return bend portion 24 communicates with the diffuser flow path 23, and the other end side (downstream side) communicates with the guiding flow path 25.

The return bend portion 24 reverses the flow direction of the working fluid G which is discharged from the upstream-side impeller 4 toward the outside in the radial direction Dd and has passed through the diffuser flow path 23, and guides the working fluid G to the inside in the radial direction Dd.

The guiding flow path 25 is a flow path Which is surrounded by a side wall 31B of the partition member 31 of the casing 3 facing the downstream side and a side wall 32A of the extension portion 32 facing the upstream side. Here, the side wall 31B forms an upstream wall surface on the first side of the guiding flow path 25 in the axis O direction.

An outer end portion of the guiding flow path 25 in the radial direction Dd is connected to a downstream side of the return bend portion 24. In addition, as described above, an inner end portion of the guiding flow path 25 in the radial direction Dd communicates with the suction flow path 21 in a subsequent stage flow path 2. The working fluid G, which has passed through the return bend portion 24, is introduced into the inside in the radial direction Dd and is guided to the downstream-side impeller 4 through the guiding flow path 25.

The centrifugal compressor 100 includes a return vane 50 in the guiding flow path 25. As shown in FIG. 3, a plurality of the return vanes 50 are provided at intervals in the circumferential direction around the axis O. The plurality of return vanes 50 are radially arranged about the axis O in the guiding flow path 25. Specifically, each return vane 50 is formed of a plate material which extends from the side wall 31B of the partition member 31 toward the side wall 32A of the extension portion 32. Each return vane 50 has a shape in which an intermediate portion 53 in the radial direction curvedly bulges toward one side in a rotation direction of the impeller 4 with respect to a leading edge 51 positioned on the outside in the radial direction Dd and a trailing edge 52 positioned on the inside in the radial direction Dd. In addition, each return vane 50 is formed such that the trailing edge 52 extends toward the axis O (center of the rotor 1) in the radial direction Dd.

In each return vane 50, the leading edge 51 positioned on the outside in the radial direction Dd is formed to be orthogonal to a flow direction F of the working fluid flowing through the guiding flow path 25, that is, is linearly formed along the axis O (in the present embodiment, to be parallel with the axis O).

In the return vane 50, the trailing edge 52 positioned on the inside in the radial direction Dd is formed such that a second end portion 52*b* on the second side in the axis O direction is positioned closer to the inside in the radial direction Dd than the first end portion 52*a* on the first side in the axis O direction. Specifically, in the trailing edge 52 of the return vane 50, the second end portion 52*b* is positioned closer to the inside in the radial direction Dd than a normal line V extending perpendicularly to the side wall 31B from the first end portion 52*a*. In addition, the trailing edge 52 of the return vane 50 linearly extends to the inside in the radial direction Dd gradually from the first end portion 52*a* toward the second end portion 52*b*.

Accordingly, in a length of the return vane 50 from the leading edge 51 to the trailing edge 52 along the flow direction of the working fluid G, the return vane 50 is formed such that the length on the second side in the axis O direction is longer than the length on the first side in the axis O direction.

Moreover, the return vane 50 is formed such that a length of the trailing edge 52 in the axis O direction is longer than a length of the leading edge 51 positioned on the outside in the radial direction.

Subsequently an operation of the centrifugal compressor 100 according to the present embodiment will be described.

In the centrifugal compressor 100 Which is normally operated, the working fluid G exhibits the following behavior.

First, the working fluid U which is taken front the intake port 7 into the flow path 2 flows into the compression flow path 22 in the impeller 4 through the first stage suction flow path 21. The impeller 4 is rotated around the axis O according to a rotation of the rotor 1, and thus, a centrifugal force is applied to the working fluid G in the compression flow path 22 from the axis O toward the outside in the radial direction Dd. In addition, as described above, the cross-sectional area of the compression flow path 22 gradually decreases from the outside in the radial direction Dd to the inside, and thus, the working fluid G is gradually compressed. Accordingly, a high-pressure working fluid G is fed out from the compression flow path 22 to the subsequent diffuser flow path 23.

Thereafter, the high-pressure working fluid G, which has flowed out from the compression flow path 22, passes through the diffuser flow path 23, the return bend portion 24, and the guiding flow path 25 in this order. Thereafter, the same compression is applied to the second stage and subsequent stage impellers 4 and flow paths 2. Finally, the working fluid G reaches a desired compression state, and is supplied from the exhaust port 8 to an external device (not shown).

Here, in the working fluid G passing through the guiding flow path 25, a turning component around the axis O is reduced by the return vane 50 provided in the guiding flow path 25. The length of the return vane 50 along the flow direction of the working fluid G on the second side in the axis O direction is longer than that on the first side in the axis O direction. Accordingly, in a suppression effect of the turning component of the working fluid G applied by the return vane 50 with respect to the working fluid G flowing along the return vane 50 in the guiding flow path 25, the suppression effect on the second end portion 52*b* side on the second side is higher than the suppression effect on the first end portion 52*a* side on the first side in the axis O direction.

FIG. 4 is a diagram showing a distribution P of strength of the turning component in a case where the second end portion 52*b* is positioned on the inside in the radial direction Dd with respect to the first end portion 52*a* in the trailing edge 52 of the return vane 50. For comparison, FIG. 4 shows a distribution Q of strength of the turning component in a case where the first end portion 52*a* and the second end portion 52*b* of the trailing edge 52 are formed at the same position as each other in the radial direction, that is, the trailing edge 52 is linearly formed along the axis O direction.

As shown in FIG. 4, in the trailing edge 52 of the return vane 50, the second end portion 52*b* is disposed on the inside in the radial direction Dd with respect to the first end portion 52*a*, and thus, the turning component remaining in the working fluid G which has passed through the return vane 50 can be more evenly supported in the axis O direction.

As described above, in the centrifugal compressor 100 according the present embodiment, in the return vane 50 provided in the guiding flow path 25, the trailing edge 52 positioned on the inside in the radial direction Dd is formed such that the second end portion 52*b* on the second side in the axis O direction is positioned closer to the inside in the radial direction Dd than the first end portion 52*a* on the first side in the axis O direction. According to this configuration, in the suppression effect of the turning component of the working fluid G applied by the return vane 50 with respect to the working fluid G flowing along the return vane 50 in the guiding flow path 25, the suppression effect on the second side in the axis O direction is higher, and thus, the turning component remaining in the working fluid G which has passed through the return vane 50 can be more evenly suppressed in the axis O direction. As a result, it is possible to improve efficiency of the centrifugal compressor 100.

In addition, the length of the return vane 50 along the flow direction of the working fluid G on the second side in the axis O direction is longer than that on the first side in the axis O direction, and thus, it is possible to increase the length of the working fluid G flowing along the return vane 50 in the guiding flow path 25. Accordingly, in the suppression effect of the turning component of the working fluid G, it is possible to increase the suppression effect on the second side in the axis O direction.

In addition, the trailing edge 52 of the return vane 50 gradually extends to the inside in the radial direction Dd from the first end portion 52*a* toward the second end portion 52*b*. Accordingly, the suppression effect of the turning component of the working fluid G can gradually increase from the first side in the axis O direction toward the second side.

In addition, in the return vane 50, the leading edge 51 is linearly formed to be orthogonal to the flow direction of the working fluid G. Accordingly, the leading edge 51 is linearly formed, and thus, it is possible to easily process the leading edge 51.

Second Embodiment

Next, a second embodiment of the centrifugal rotary machine according to the present invention will be described. Compared to the first embodiment, in the second embodiment described later, only a shape of a trailing edge 52B of a return vane 50B is different, and thus, the same reference signs are assigned to the same portions as those of the first embodiment, and repeated descriptions are omitted.

Figure 5:
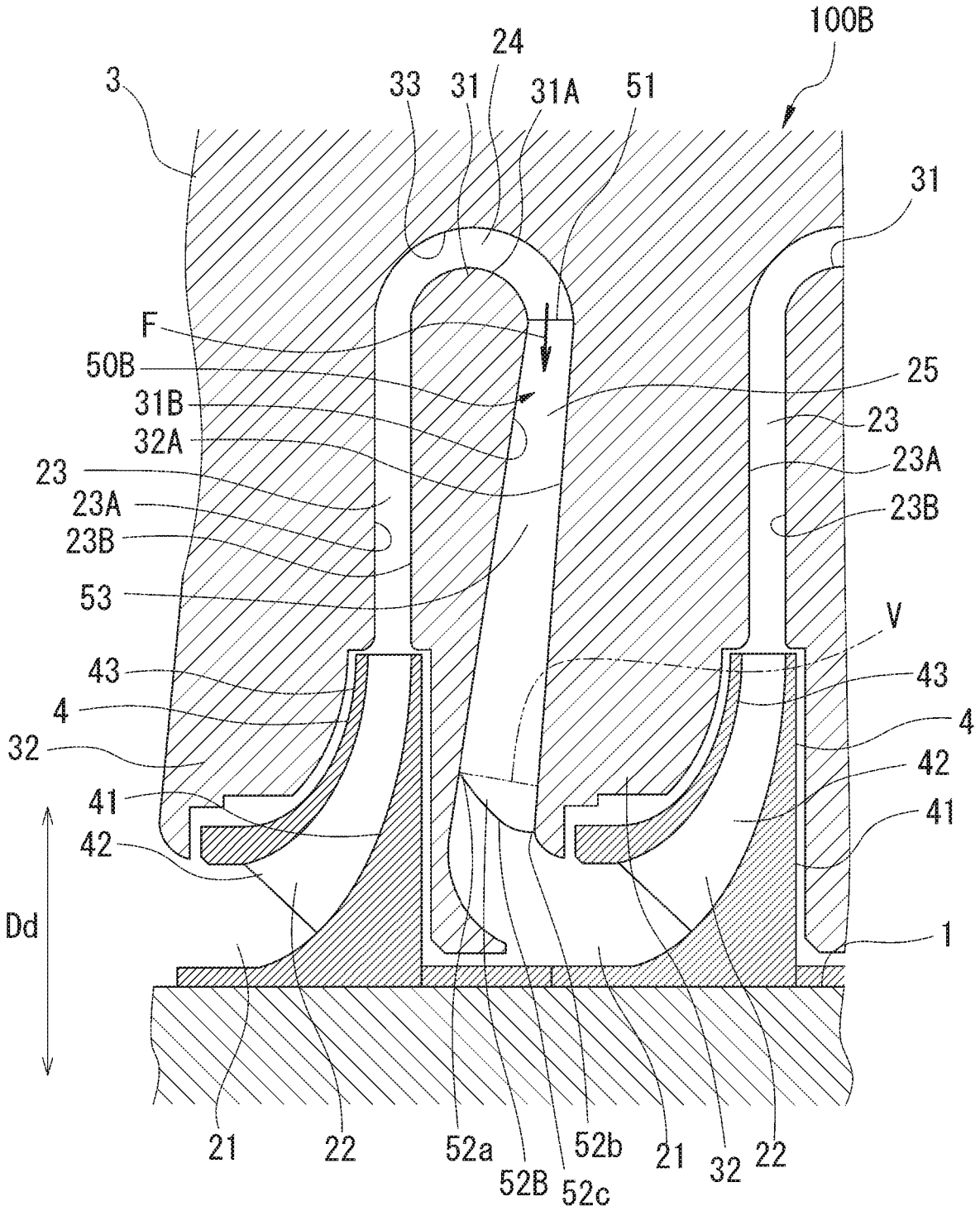
FIG. 5 is an enlarged sectional view of a main portion of a centrifugal compressor according to a second embodiment of the present invention.

FIG. 5 is an enlarged sectional view of a main portion of the centrifugal compressor according to the second embodiment of the present invention.

As shown in FIG. 5, a centrifugal compressor 100B in this embodiment includes the return vane 50B in the guiding flow path 25.

In the return vane 50B, the trailing edge 52B positioned on the inside in the radial direction Dd is formed such that the second end portion 52*b* on the second side in the axis O direction is positioned closer to the inside in the radial direction Dd than the first end portion 52*a* on the first side in the axis O direction. Specifically, in the trailing edge 52B of the return vane 50B, the second end portion 52*b* is positioned closer to the inside in the radial direction Dd than the normal line V extending perpendicularly to an upstream wall surface on the first side in the axis O direction in the guiding flow path 25 from the first end portion 52*a*.

In the trailing edge 52B of the return vane 50B, an intermediate portion 52*c* between the first end portion 52*a* and the second end portion 52*b* is curvedly formed to be convex toward the downstream side in the flow direction of the working fluid G; that is, toward the inside in the radial direction Dd.

As described above, in the centrifugal compressor 100B according to the present embodiment, in the return vane 50B in the guiding flow path 25, the trailing edge 52B positioned on the inside in the radial direction Dd is formed such that the second end portion 52*b* on the second side in the axis O direction is positioned closer to the inside in the radial direction Dd than the first end portion 52*a* on the first side in the axis O direction. According to this configuration, in a suppression effect of the turning component of the working fluid G applied by the return vane 50B with respect to the working fluid G flowing along the return vane 50B in the guiding flow path 25, the suppression effect on the second side in the axis O direction is higher, and thus, the turning component remaining in the working fluid G which has passed through the return vane 50B can be more evenly suppressed in the axis O direction. As a result, it is possible to improve efficiency of the centrifugal compressor 100B.

In addition, the trailing edge 52B of the return vane 50B is curvedly formed to be convex to the downstream side along the flow direction of the working fluid G between the first end portion 52*a* and the second end portion 52*b*. Accor this configuration, due to the intermediate portion 52*c* between the first end portion 52*a* and the second end portion 52*b*, it is possible to increase or decrease the suppression effect of the turning component of the working fluid G applied by the return vane 50B. Accordingly, it is possible to optimize the suppressing effect of the turning component of the working fluid G by forming a shape of the trailing edge 52 according to a remaining degree of the turning component of the working fluid in the axis O direction.

Modification Example of Second Embodiment

Moreover, in the second embodiment, in the trailing edge 52B of the return vane 50B, the intermediate portion 52*c* between the first end portion 52*a* and the second end portion 52*b* is formed to be convex to the downstream side (the inside in the radial direction Dd) along the flow direction of the working fluid G. However, the present invention is not limited to this.

Figure 6:
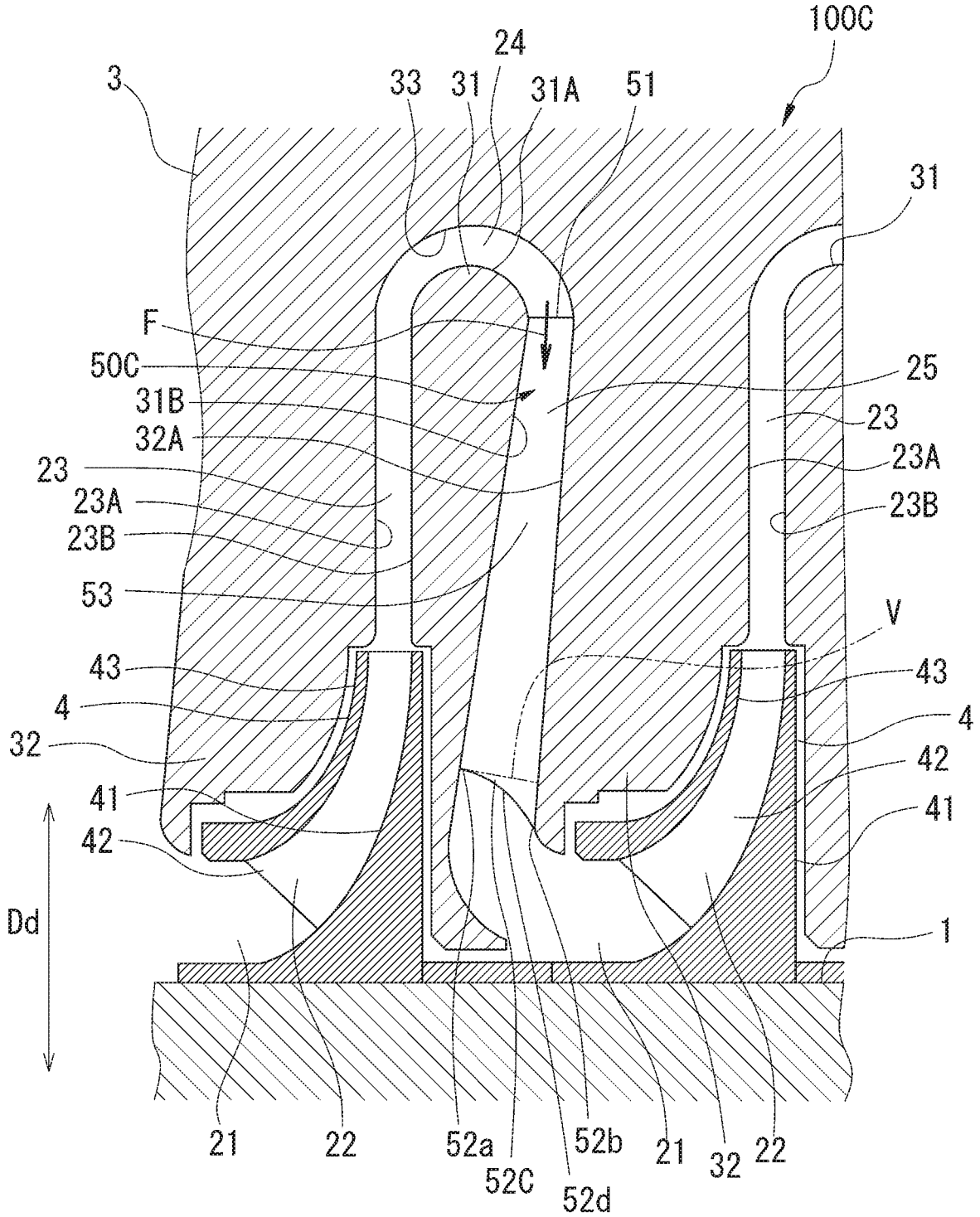
FIG. 6 is an enlarged sectional view of a main portion of a modification example of the centrifugal compressor according to the second embodiment of the present invention.

FIG. 6 is an enlarged sectional view of a main portion of a modification example of the centrifugal compressor according to the second embodiment of the present invention.

For example, as shown in FIG. 6, in a return vane 50C provided in the guiding flow path 25 of a centrifugal compressor 100C, in a trailing edge 52C, an intermediate portion 52*d* between the first end portion 52*a* and the second end portion 52*b* may be formed to be concave to the upstream side (the outside in the radial direction Dd) along the flow direction of the working fluid G.

Hereinbefore, the respective embodiments of the present invention are described with reference to the drawings. However, the respective embodiments are only examples, and various modifications can be applied to the configurations.

For example, the number of compression stages (the number of impellers 4, the number of flow paths 2) of the centrifugal compressors 100, 100B, and 100C are not limited by the above-described embodiments, and may be appropriately set according to design and specifications.

Moreover, it is not essential to provide each of the return vanes 50, 50B, and 50C shown in the first embodiment and the second embodiment in all stages of each of the centrifugal compressor 100, 100B, and 100C.

Each of the return vanes 50, 50B, 50C shown in the first embodiment and the second embodiment may be provided in the guiding flow path 25 which guides the working fluid G to at least one impeller 4 of the impellers 4 provided in the plurality of stages.

INDUSTRIAL APPLICABILITY

The present invention can be applied to a centrifugal rotary machine.

REFERENCE SIGNS LIST

1: rotor
2: flow path
3: casing
4: impeller
5: journal bearing
6: thrust bearing
7: intake port
8: exhaust port
21: suction flow path
22: compression flow path
23: diffuser flow path
23A: diffuser front wall
23B: diffuser rear wall
24: return bend portion
25: guiding flow path
31: partition member
31A: outer peripheral wall
31B: side wall
32: extension portion
32A: side wall
33: reverse wall
41: disk
42: vane
43: shroud
50, 50B, 50C: return vane
51: leading edge
52, 52B, 52C: trailing edge
52*a*: first end portion
52*b*: second end portion

52*c*, 52*d*: intermediate portion
53: intermediate portion
100, 100B, 1000: centrifugal compressor (centrifugal rotary machine)
Dd: radial direction
F: flow direction
G: working fluid
O: axis

The invention claimed is:

1. A centrifugal rotary machine comprising:

impellers which are provided in a plurality of stages along an axial direction and discharge a working fluid sucked from a first side in the axial direction to an outside in a radial direction of an axis; and a casing which is provided to surround the impellers and forms a flow path which leads the working fluid discharged from an upstream-side impeller positioned on the first side in the axial direction to a downstream-side impeller positioned on a second side in the axial direction, wherein the flow path includes a return bend portion which guides the working fluid to an inside in the radial direction by reversing the working fluid discharged to an outside in the radial direction from the upstream-side impeller, and a guiding flow path which is connected to a downstream side of the return bend portion and leads the working fluid to the inside in the radial direction so as to guide the working fluid to the downstream-side impeller, wherein the centrifugal rotary machine further comprises a plurality of return vanes which are provided in the guiding flow path guiding the working fluid in at least one impeller from among the impellers provided in the plurality of stages and which are provided at intervals in a circumferential direction around the axis, and wherein in each return vane, a trailing edge positioned on the inside in the radial direction is formed such that a second end portion on the second side in the axial direction is positioned closer to the inside in the radial direction than a first end portion on the first side in the axial direction.

2. The centrifugal rotary machine according to claim 1, wherein each return vane is formed such that a length along a flow direction of the working fluid on the second side in the axial direction is longer than that on a length along a flow direction on the first side in the axial direction.

3. The centrifugal rotary machine according to claim 1, wherein the trailing edge of each return vane gradually extends to the inside in the radial direction from the first end portion toward the second end portion.

4. The centrifugal rotary machine according to claim 1, wherein the trailing edge of each return vane is curvedly formed to be convex toward the inside in the radial direction or to be concave toward the outside in the radial direction between the first end portion and the second end portion.

5. The centrifugal rotary machine according to claim 1, wherein in the trailing edge of each return vane, the second end portion is positioned closer to the inside in the radial direction than a normal line extending perpendicularly to an upstream wall surface on the first side in the axial direction in the guiding flow path from the first end portion.

6. The centrifugal rotary machine according to claim 1, wherein in each return vane, a leading edge positioned on the outside in the radial direction is linearly formed along the axis.

7. The centrifugal rotary machine according to claim 1, wherein in each return vane, an axial length of the trailing edge is longer than that of the leading edge positioned on the outside in the radial direction.

8. The centrifugal rotary machine according to claim 2, wherein the trailing edge of each return vane gradually extends to the inside in the radial direction from the first end portion toward the second end portion.

9. The centrifugal rotary machine according to claim 2, wherein the trailing edge of each return vane is curvedly formed to be convex toward the inside in the radial direction or to be concave toward the outside in the radial direction between the first end portion and the second end portion.

10. The centrifugal rotary machine according to claim 2, wherein in the trailing edge of each return vane, the second end portion is positioned closer to the inside in the radial direction than a normal line extending perpendicularly to an upstream wall surface on the first side in the axial direction in the guiding flow path from the first end portion.

11. The centrifugal rotary machine according to claim 3, wherein in the trailing edge of each return vane, the second end portion is positioned closer to the inside in the radial direction than a normal line extending perpendicularly to an upstream wall surface on the first side in the axial direction in the guiding flow path from the first end portion.

12. The centrifugal rotary machine according to claim 4, wherein in the trailing edge of each return vane, the second end portion is positioned closer to the inside in the radial direction than a normal line extending perpendicularly to an upstream wall surface on the first side in the axial direction in the guiding flow path from the first end portion.

13. The centrifugal rotary machine according to claim 2, wherein in each return vane, a leading edge positioned on the outside in the radial direction is linearly formed along the axis.

14. The centrifugal rotary machine according to claim 3, wherein in each return vane, a leading edge positioned on the outside in the radial direction is linearly formed along the axis.

15. The centrifugal rotary machine according to claim 4, wherein in each return vane, a leading edge positioned on the outside in the radial direction is linearly formed along the axis.

16. The centrifugal rotary machine according to claim 2, wherein in each return vane, an axial length of the trailing edge is longer than that of the leading edge positioned on the outside in the radial direction.

17. The centrifugal rotary machine according to claim 3, wherein in each return vane, an axial length of the trailing edge is longer than that of the leading edge positioned on the outside in the radial direction.

18. The centrifugal rotary machine according to claim 4, wherein in each return vane, an axial length of the trailing edge is longer than that of the leading edge positioned on the outside in the radial direction.

* * * * *